US008588435B2

(12) United States Patent
Bominaar-Silkens et al.

(10) Patent No.: US 8,588,435 B2
(45) Date of Patent: Nov. 19, 2013

(54) MICROPHONE

(75) Inventors: Iris Bominaar-Silkens, Valkenswaard (NL); Sima Tarashioon, Delft (NL); Remco Henricus Wilhelmus Pijnenburg, Hoogeloon (NL); Twan van Lippen, Bladel (NL); Geert Langereis, Eindhoven (NL)

(73) Assignee: NXP B.V., Eindhoven (NL)

( * ) Notice: Subject to any disclaimer, the term of this patent is extended or adjusted under 35 U.S.C. 154(b) by 219 days.

(21) Appl. No.: 12/909,344

(22) Filed: Oct. 21, 2010

(65) Prior Publication Data

US 2011/0123052 A1 May 26, 2011

(30) Foreign Application Priority Data

Oct. 23, 2009 (EP) ..... 09173967

(51) Int. Cl.
*H04R 25/00* (2006.01)

(52) U.S. Cl.
USPC ..... 381/174; 381/369; 381/150

(58) Field of Classification Search
USPC ..... 381/174, 369
See application file for complete search history.

(56) References Cited

U.S. PATENT DOCUMENTS

| | | | | |
|---|---|---|---|---|
| 5,363,452 | A | 11/1994 | Anderson | |
| 6,293,154 | B1 | 9/2001 | Kurtz | |
| 7,318,349 | B2 * | 1/2008 | Vaganov et al. | 73/514.33 |
| 8,130,979 | B2 * | 3/2012 | Harney et al. | 381/94.7 |
| 2006/0237806 | A1 * | 10/2006 | Martin et al. | 257/415 |
| 2007/0056377 | A1 | 3/2007 | Matsubara | |
| 2008/0192963 | A1 | 8/2008 | Sato | |
| 2012/0091546 | A1 | 4/2012 | Langereis et al. | |

FOREIGN PATENT DOCUMENTS

| | | | |
|---|---|---|---|
| WO | 2009/077917 | A2 | 6/2009 |
| WO | 2010/103410 | A1 | 9/2010 |
| WO | 2010/113107 | A1 | 10/2010 |
| WO | 2010/116324 | A1 | 10/2010 |

OTHER PUBLICATIONS

Bourne, M.,: "The Top Ten Reasons for Using MEMS in Cell Phones," white paper, In-StatMDR (Sep. 2003).
Extended European Search Report for European Patent Appln. No. 09173967.2 (Mar. 26, 2010).

* cited by examiner

*Primary Examiner* — Brian Ensey
*Assistant Examiner* — Sabrina Diaz

(57) ABSTRACT

A microphone and a method for manufacturing the same. The microphones includes a substrate die; and a microphone and an accelerometer formed from the substrate die. The accelerometer is adapted to provide a signal for compensating mechanical vibrations of the substrate die.

15 Claims, 7 Drawing Sheets

MICROPHONE

This application claims the priority under 35 U.S.C. §119 of European patent application no. 09173967.2, filed on Oct. 23, 2009, the contents of which are incorporated by reference herein.

FIELD OF THE INVENTION

This invention relates to a microphone, particularly a capacitive microphone.

BACKGROUND OF THE INVENTION

FIG. 1 shows schematically the principle of operation of a known capacitive microphone. Sound pressure waves 1 make a membrane 10 vibrate due to a pressure difference over the membrane. This varies the airgap spacing between the membrane 10 and a backplate 11. For a good omni-directional performance, the back side of the membrane faces an acoustically closed back chamber 12. A small hole 14 in the back chamber is required to compensate for slow changes in atmospheric pressure.

In order to detect the movement of the membrane, it is placed in a parallel plate capacitor set-up. To do so, the membrane has a conducting surface and the back-plate is also conducting, placed to create the air gap. An electrically detectable signal, proportional to the sound pressure, is available due to modulation of the air gap by the sound pressure difference.

The membrane and backplate are normally made in a silicon MEMS process while the back-chamber can be defined by the device package.

MEMS microphones are of particular interest for applications requiring miniaturization, for example for mobile phones and for PCB mounting in other hand held devices.

One problem not addressed by these designs is "body noise" suppression.

Due to mechanical vibrations the two parallel plates of the microphone capacitor will experience relative movement, leading to the detection of an unwanted electrical signal. This disturbing effect of mechanical vibrations resulting into an electrical output on the microphone is named "body noise". The body noise is mainly caused by the deflection of the membrane; the backplate deflects much less in response to mechanical vibrations.

One example of body noise is cross-talk of a mobile phone's own speaker (or receiver) into the microphone. Such an effect has a nonlinear transfer function and can, thus, not be compensated for by signal processing of the microphone output signal alone.

United States Patent Application Publication Number US 2008/192963 A1 discloses a condenser microphone and an accelerometer placed on a device substrate.

United States Patent Application Publication Number US 2006/237806 A1 presents a microphone formed from a silicone or silicon-on-insulator (SOI) wafer.

U.S. Pat. No. 6,293,154 discloses a pressure sensing device for producing an output proportional to an applied pressure irrespective of vibration and acceleration of the device.

BACKGROUND OF THE INVENTION

According to the invention, there is provided a microphone comprising: a substrate die 24; and a microphone 20 and an accelerometer 22 formed from the substrate die, wherein the accelerometer is adapted to provide a signal for compensating mechanical vibrations of the substrate die.

Thus, embodiments provide an accelerometer in the same die as the microphone, allowing cancellation of the mechanical vibrations in the acoustical signal via electronic signal subtraction. Further, the accelerometer facilitates new functionality for devices that accommodate microphone modules with an accelerometer. For example, an active function of a device may be terminated a device function by shaking the device, and/or a function may be enabled/disabled by turning over the device.

The accelerometer may be produced in the same process as that used to produce the microphone so that no additional process steps are required.

Also, the accelerometer may be positioned close to the MEMS microphone without changing the physical size of the MEMS microphone die so that no additional silicon area is required.

According to another aspect of the invention, there is provided a method of manufacturing a microphone comprising: providing a substrate die; and forming a microphone and an accelerometer from the substrate die, wherein the accelerometer is adapted to provide a signal for compensating mechanical vibrations of the substrate die.

The step of forming may comprise forming a MEMs capacitive microphone comprising a backplate separated from a sensor membrane by an air gap, and forming a MEMs capacitive accelerometer comprising a suspended mass.

BRIEF DESCRIPTION OF THE DRAWINGS

Examples of the invention will now be described with reference to the accompanying drawings, in which.

SUMMARY OF THE INVENTION

The drawings are not to scale, and some dimensions may have been exaggerated (for example the thickness dimension) to make the drawings show the different components more clearly.

Figure 1:
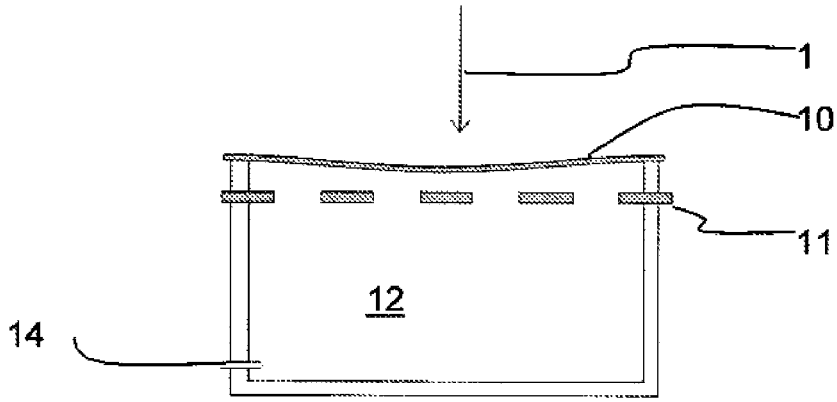
FIG. 1 Prior Art
FIG. 1 shows schematically the principle of operation of a known capacitive microphone.
Figure 2:
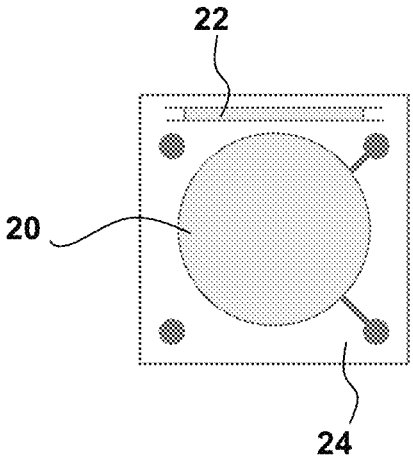
FIG. 2 shows a plan view of an exemplary die lay-out according to an embodiment of the invention.

FIG. 2 shows a plan view of an exemplary die lay-out according to an embodiment in which a MEMs capacitive microphone 20 and a capacitive accelerometer 22 are combined on a single substrate die 24. Compared to manufacturing a conventional MEMs microphone, no additional masks are necessary for the realization of the accompanying capacitive accelerometer 22. Thus, the capacitive accelerometer 22 can be added to the MEMS microphone sensor 20 without any additional manufacturing costs.

The presence of an accelerometer in a microphone module also provides additional functionality which can be advantageous for devices that do not already comprise an accelerometer.

So that the accelerometer 22 experiences the same mechanical vibrations as the microphone 20, it is preferably positioned close to the microphone on the same die 24. For signal processing, it is also convenient if the suspended mass of the accelerometer 22 has approximately the same frequency response to mechanical vibrations as the microphone, which has a linear response in the audible frequency range (up to 20 kHz).

The accelerometer 22 of the example shown in FIG. 2 is a mass-spring system which is made in the microphone-sensor layer-stack by surface-micromachining. This offers several options, of which the following are a few examples:

(i) The accelerometer mass-spring system can be made entirely in the microphone backplate layer. Then the rigid counter-electrode of the accelerometer is the silicon of which also the microphone membrane is made, and also the gap between the electrodes is made similarly to that of the microphone sensor. This specific example will be described in more detail below with reference to FIGS. 3A-3G.

(ii) The accelerometer mass-spring system can be made in the combination of microphone backplate, "sacrificial" oxide and membrane layer together. In this case the "sacrificial" oxide is only etched in the microphone and not in the accelerometer. The rigid counter-electrode of the accelerometer is then the provided by silicon substrate of the SOI wafer, and the buried oxide of the SOI wafer is etched to form the gap between the electrodes.

(iii) Like option (ii) above, but with the accelerometer mass in the mentioned three layers, while only one or two of these layers are used for the accelerometer springs.

Referring now to FIGS. 3A-3G, a method of manufacturing a MEMs microphone according to an embodiment of the invention will described, wherein the accelerometer mass-spring system is made entirely in the microphone backplate layer (in accordance with option (i) above).

Figure 3A:
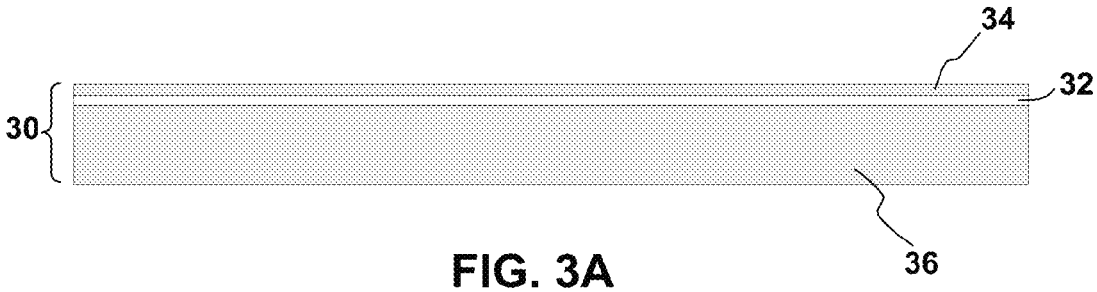
FIGS. 3A to 3G illustrate a method of manufacturing a MEMs microphone according to an embodiment of the invention.

Firstly, as shown in FIG. 3A, the process begins with the provision of a Silicon-on-Insulator (SOI) wafer substrate 30. Here the SOI wafer substrate 30 comprises a layer of Silicon Dioxide ($SiO_2$) 32 sandwiched between an upper 34 and lower 36 layer of Silicon (Si).

Figure 3B:
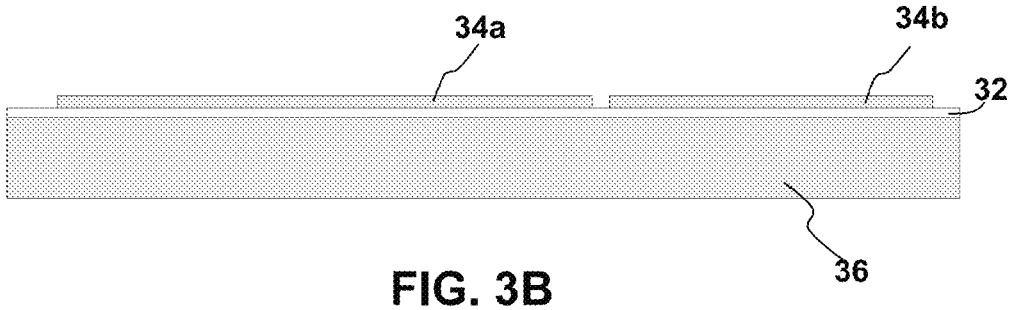

Next, the upper Si layer 34 is patterned so as to provide first 34*a* and 34*a* second portions as shown in FIG. 3B. This first portion 34*a* of the Si layer 34 will become the microphone membrane and the second portion 34*b* of the Si layer 34 will become a fixed electrode of the accelerometer. The SOI wafer 30 ensures that the stress of this layer is low tensile so as to produce a sensitive microphone since the microphone sensitivity is determined by the (tensile) stress in the membrane.

Figure 3C:
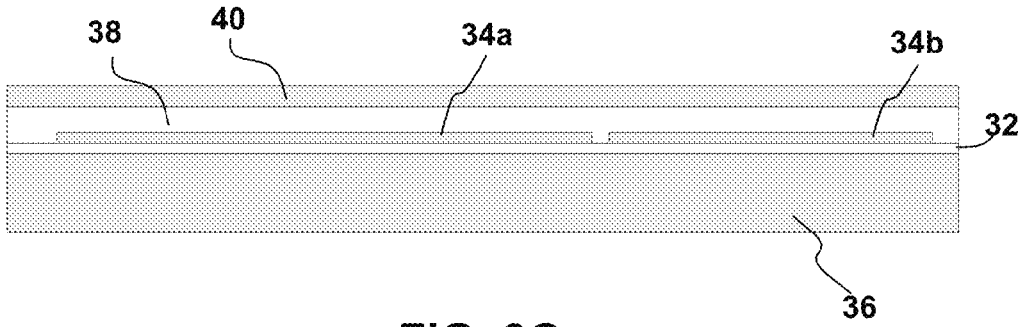

As shown in FIG. 3C, an additional Silicon Dioxide ($SiO_2$) (for example TEOS or LPCVD) layer 38 is deposited over the patterned upper layer 34 and then subsequently covered with a polysilicon layer 40. As will be shown later, the region of the polysilicon layer 40 above first portion 34*a* of the Si layer 34 will form the backplate of the microphone, and the region of the polysilicon layer 40 above second portion 34*b* of the Si layer will form the suspended mass of the accelerometer.

Figure 3D:
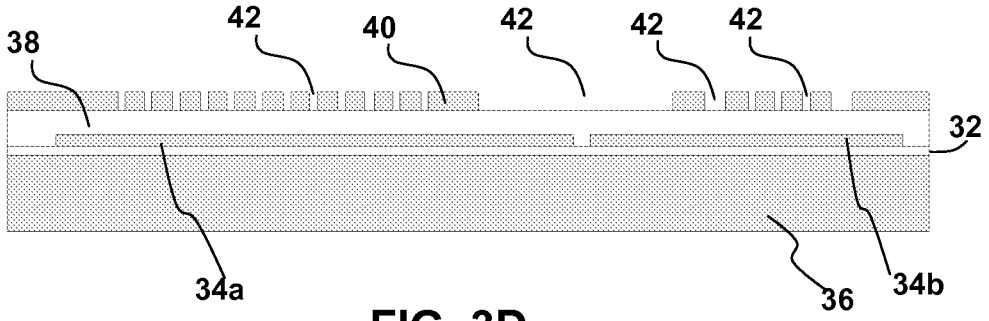

Holes 42 are then etched in the polysilicon layer 40 (using a reactive ion etch process for example) as shown in FIG. 3D. These holes 42 are provided for a subsequent sacrificial layer etching process. Further, the holes 42 are also provided to make the backplate of the microphone acoustically transparent.

Figure 3E:
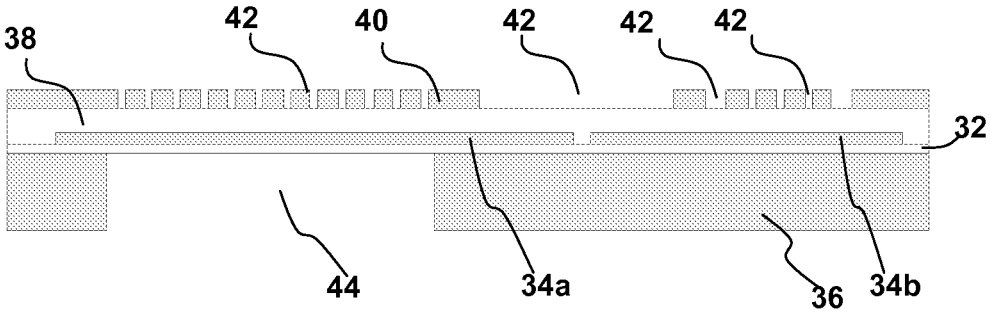

Next, using Deep Reactive Ion Etching (DRIE), or alternatively wet anisotropic etching in KOH or TMAH, a portion of the lower 36 layer of Silicon (Si) is etched away so as to form a cavity 44 at the position of the microphone, as shown in FIG. 3E.

Figure 3F:
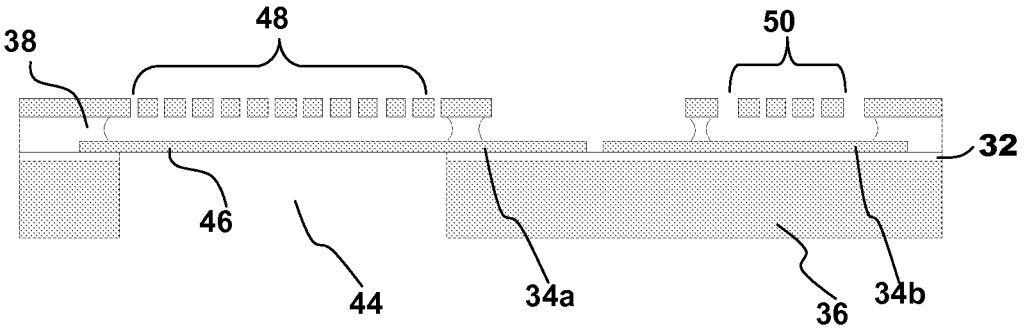

A sacrificial layer etching process is then undertaken through the holes 42 to remove portions of the $SiO_2$ layer 38 as shown in FIG. 3F. This releases the first portion 34*a* Si layer 34 from the region of the polysilicon layer 40 above it, thereby forming a membrane portion 46 from the first portion 34*a* of the Si layer 34, and forming a backplate 48 from the region of the polysilicon layer 40 above it. In addition, the region of the polysilicon layer 40 above second portion 34*b* of the Si layer 34 is released from the Si layer 34 so as to form the suspended mass 50 of the accelerometer.

Figure 3G:
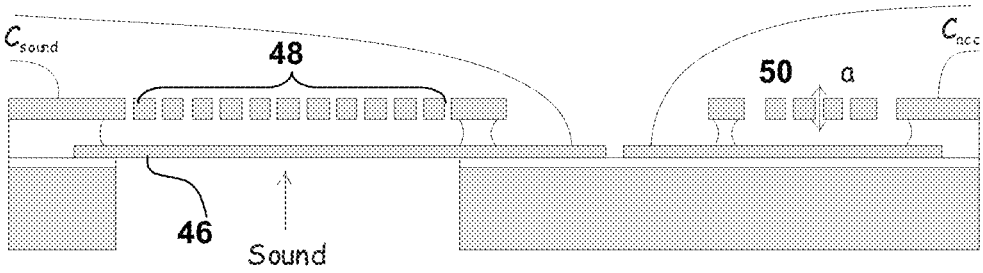

Thus, the final structure shown in FIG. 3G comprise a MEMS capacitive microphone (on the left side) and a MEMS capacitive accelerometer (on the right side). The capacitance Csound between the electrically conductive surfaces of the membrane 46 and backplate 48 provides a measure of an incident acoustic signal and the mechanical vibrations of the device. Similarly, the capacitance Cacc between the electrically conductive surfaces of the suspended mass 50 and the second portion 34*b* of the Si layer 34 provides a measure of mechanical vibrations (depicted by the arrow labelled "a") of the microphone.

It will be appreciated that the manufacturing process described above requires no additional masks when compared to manufacturing the MEMS microphone only.

Preferably, the accelerometer will be formed to fit next to the microphone on the same die so as to limit the amount of additional space required.

Referring now to FIGS. 4A-4F, embodiments of the invention comprise a circular microphone backplate 48 positioned at the center of the silicon die 51. Four bondpads 52*a*-52*c* are provided around the microphone membrane portion 46.

The four bondpads 52*a*-52*d* are provided to operate both microphone and accelerometer. A first bondpad 52*a* provides an electrical connection to the microphone membrane portion 46, a second bondpad 52*b* provides an electrical connection to the microphone backplate 48 contact, the third 52*c* bondpad provides a bulk contact, and the fourth contact 52*d* provides an electrical connection to the accelerometer mass 50.

The fixed accelerometer electrode (electrically conductive surfaces of the second portion 34*b* of the Si layer 34), which is in the microphone membrane layer, may be formed as a common electrode with the microphone if the microphone membrane is not separated from the fixed accelerometer electrode in the patterning stage of the top silicon layer (contrary to what is illustrated in FIG. 3B). In that case, the fixed accelerometer electrode does require a separate bondpad. Accordingly, alternative embodiments may comprise less than four bondpads. Also, other alternatives may even comprise more than four bondpads to make the read-out of microphone and accelerometer capacitances easier, The embodiments shown in FIGS. 4A-4F do not require additional silicon area when compared to a microphone-only die. One may also consider increasing the die size to allow an accelerometer of larger size to be combined with a microphone on the same die. There may then be a trade off made between the advantages associated with the die layout and the disadvantages associated with the additional silicon costs.

With the microphone and four bondpads 52*a*-52*d* present, the accelerometer can be positioned in a corner of the die or along an edge of the die. Several exemplary configurations are shown in FIGS. 4A-4F.

In all embodiments of FIGS. 4A-4F, the accelerometer is a mass that is suspended elastically. It can be a circular plate, like the microphone membrane, but it may also be of rectangular (or square) shape, polygonal form or a part of a ring. It can be suspended along its full edge, like the microphone membrane, or along only specific edges, for example like a beam clamped at opposite edges.

Figure 4:
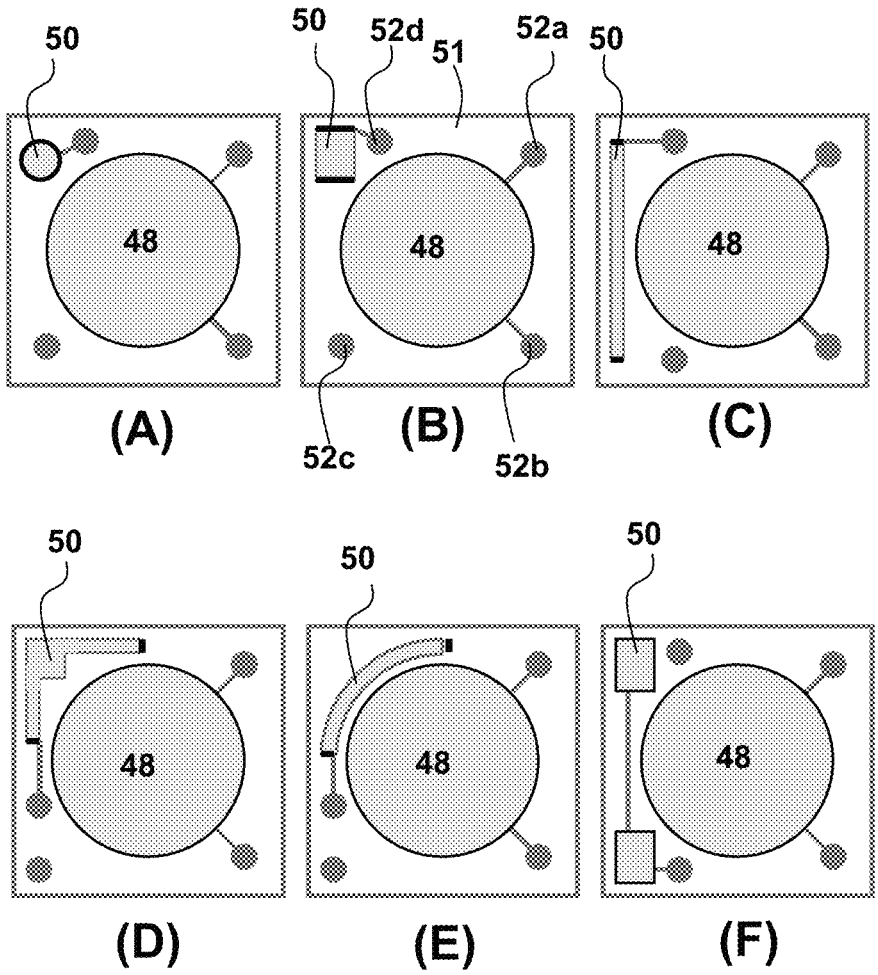
FIGS. 4A-4F are schematic plan views of die lay-outs according to different embodiments of the invention.

It may also be desired to provide more than one accelerometer on the die, as shown in FIG. 4F. An electrical contact formed in the layer of the accelerometer mass (microphone backplate layer) may then enable the same bondpad 52*c* to be used for the plurality of accelerometers. However, for improved performance, the two accelerometers would preferably be substantially identical.

Further to the above, the accelerometer will preferably be formed so as to be sensitive to mechanical vibrations in the growth direction (i.e. perpendicular to the plane of the layers) of the structure (as the microphone is sensitive to mainly vibrations in this direction) and also insensitive to sound.

To achieve sensitivity only in the direction perpendicular to the layer structure, the accelerometer suspension is preferably designed to be flexible in the growth direction of the structure, while being inflexible (i.e. non sensitive) to in-plane mechanical vibrations. This requirement can be fulfilled by designing the elastic suspension such that it is flexible only in the desired direction (high compliance, low spring constant) and stiff in the other directions (low compliance, high spring constant).

The accelerometer can be made less sensitive to sound than the microphone by designing its mass to have a smaller area than the microphone membrane. The smaller area reduces the sensitivity to acoustical pressure, and by perforating the accelerometer mass, which is also desirable for the sacrificial-layer etch that releases the accelerometer mass, the mass may even be made substantially acoustically transparent.

It may also be advantageous to form the accelerometer so that it has frequency of resonance above the intended acoustical bandwidth of the microphone (typically 20 kHz). This provides a linear response in the audible frequency range. In addition, the resonance frequency may be limited because a higher resonance frequency provides a lower sensitivity to accelerations/vibrations. A preferred range of resonance frequencies for the accelerometer may therefore be in the range of between 25 kHz and 100 kHz.

The fundamental resonance frequency of a mass-spring system is determined by its mass and its spring constant. If the accelerometer mass is formed in the microphone backplate layer, the material density and the layer thickness cannot be used as design parameters. The mass can, thus, only be tuned by its area (which may be limited by the space on the die, as stated in the first requirement). The spring constant depends on the geometry of the elastic suspension and the stress in the layer. Again, the material density and layer thickness, may be defined by the microphone membrane manufacturing process, thus limiting the tuning possibilities to the in-plane geometry of the suspension.

In FIGS. 5A-5D, several exemplary accelerometer configurations are shown with which frequency matching may be achieved. All configurations are based on a beam-like structure 55 that is positioned next to the microphone, along the edge of the silicon die (like the configuration shown in FIG. 4*c*). As mentioned above, the length and width of the beam may be chosen such that the accelerometer has a predetermined mass. The perforation of the accelerometer mass, which is provided for sacrificial layer etching process and for making the accelerometer acoustically transparent, is drawn schematically as a plurality of holes/apertures 56 formed in the beam-like structure 55.

Figure 5:
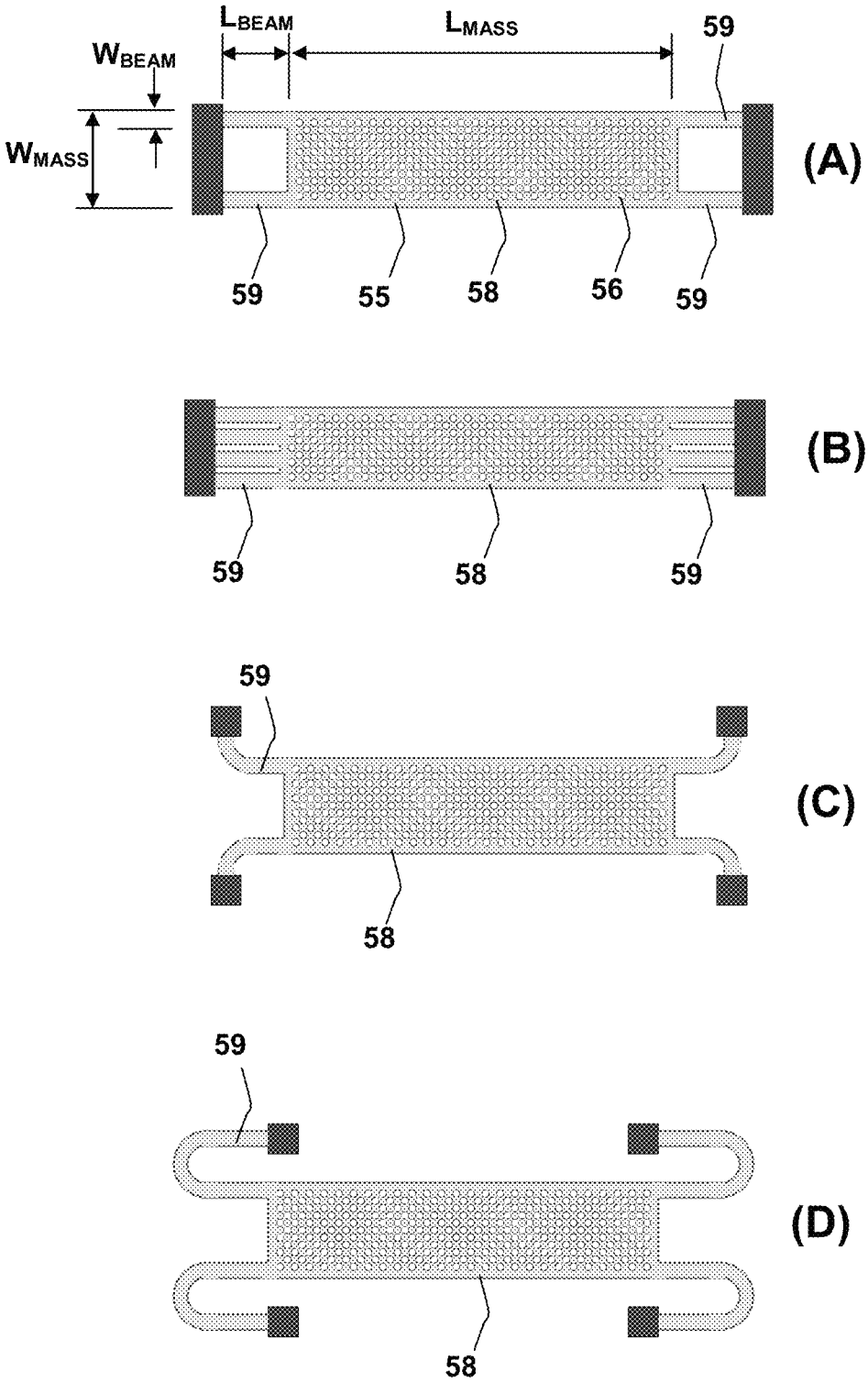
FIGS. 5A-5D show accelerometer configurations according to different embodiments of the invention.

In FIG. 5A, the mass 58 is suspended by four straight beams 59 (two pairs of beams 59 at opposing ends of the mass). So that the elastic suspension is flexible only in the desired direction (perpendicular to the plane of the drawing) and stiff in the other directions, the beam 55 is wider than the layer thickness.

Taking into account the stress in the layer, the desired fundamental resonance frequency may be achieved by an appropriate choice of beam width and length, and number of beams (as illustrated by FIG. 5B).

FIGS. 5C and 5D show configurations for which the resonance frequency is less dependent on the stress in the layer, because the geometry of the suspension provides for relaxation of the stress.

An analytical model has been derived to predict the sensitivity and resonance frequency of the accelerometer design that is shown in FIG. 5A. The design parameters describe the central mass (of length $L_{mass}$ and width $W_{mass}$) and the four suspending beams, which each have a length $L_{beam}$ and width $W_{beam}$. To verify the applicability of the analytical model, the analytical results have been compared to finite-element calculations for the same configuration. As the accelerometer is made in the microphone backplate layer, known specifications known for the backplate layer have been used as follows: a polysilicon layer of 3 m thickness with an initial in-plane stress of 180 MPa. The perforation holes occupy 30% of the central-mass area.

Table 1 below details the estimated results for the dependencies of the sensitivity and resonance frequency $f_0$ on the accelerometer geometry (for the example of FIG. 5A).

TABLE 1

| $L_{mass}$ [μm] | $W_{mass}$ [μm] | $L_{beam}$ [μM] | $W_{beam}$ [μm] | $f_0$ [kHz] | $C_0$ [pF] | sens. [aF/g] | sens. [‰$C_0$/g] |
|---|---|---|---|---|---|---|---|
| 250-800 | 100 | 200 | 5 | 95-52 | 0.11-0.35 | 1-14 | 0.01-0.04 |
| 800 | 40-100 | 200 | 5 | 77-52 | 0.14-0.35 | 2-14 | 0.01-0.04 |
| 800 | 100 | 100-250 | 5 | 80-46 | 0.35 | 4-19 | 0.01-0.05 |
| 800 | 100 | 250 | 15-3 | 73-37 | 0.35 | 6-30 | 0.02-0.09 |

From the first two rows of Table 1, the effect of a larger mass is shown. By increasing the mass length $L_{mass}$ or the mass width $W_{mass}$, the resonance frequency $f_0$ decreases and the sensitivity (change of capacitance per acceleration, in units aF/g=$10^{-18}$ F/g) increases. Because the capacitor area increases, also the equilibrium capacitance $C_0$ increases. In the last column of Table 1, the sensitivity is expressed relative to $C_0$.

In the third and fourth row of Table 1, the geometry of the suspending beams is varied. It is seen that the longer and the narrower (i.e. the more flexible) the beams become, the lower the resonance frequency and the higher the sensitivity.

All design geometries in Table 1 above are sized such that they fit next to the microphone on the same die. Furthermore, these geometries clearly allow tuning of the resonance frequency in the desired frequency range from 25 kHz-100 kHz.

Because of the initial stress in the polysilicon layer, which is 180 MPa in a current MEMS microphone, an accelerometer with clamped edges (i.e. without elastic suspension: $L_{beam}$=0) will typically have a frequency of resonance that is too high. The resonance frequency of such a clamped-clamped structure can be reduced by increasing the length of the structure, but to achieve an $f_0$ below 100 kHz, the mass length $L_{mass}$ of the accelerometer should exceed the length of the microphone die (1500 m). Therefore, for an accelerometer which fits next to the microphone and which is made in a layer with such a high initial stress (>100 MPa), elastic suspensions may be required to achieve 25 kHz<f0<100 kHz.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. Any reference signs in the claims should not be construed as limiting the scope.

The invention claimed is:

1. A microphone device comprising:

a substrate die; and a capacitive microphone and an accelerometer formed from the substrate die, wherein the accelerometer is configured and arranged with a resonant frequency to provide a signal indicative of mechanical vibrations of the substrate die by the resonant frequency selectively facilitating responsiveness to mechanical vibrations and unresponsiveness to acoustical vibrations, wherein the microphone is a MEMs capacitive microphone comprising a backplate separated from a sensor membrane by an air gap, and wherein the accelerometer is a MEMs capacitive accelerometer comprising a suspended mass suspended by at least one beam, and wherein the suspended mass has a smaller area than the sensor membrane, and in that the geometries of at least one of the suspended mass and the at least one beam are adapted such that the resonant frequency of the accelerometer is within a predetermined frequency range.

2. The microphone of claim 1, wherein the accelerometer is adapted to have a frequency response which is substantially equal to a frequency response of the microphone to mechanical vibrations.

3. The microphone of claim 1, wherein the substrate die comprises a plurality of layers, and wherein the microphone and an accelerometer share at least one layer of the substrate die.

4. The microphone of claim 3, wherein the suspended mass and the backplate are formed from the same layer.

5. The microphone of claim 1, wherein the substrate die comprises a multi-layered silicon wafer having at least one layer of polysilicon.

6. The microphone of claim 1, wherein the suspended mass is perforated so as to be substantially acoustically transparent.

7. A method of manufacturing a microphone device comprising:

providing a substrate die;

forming a capacitive microphone and an accelerometer from the substrate die, wherein the accelerometer is configured and arranged with a resonant frequency to provide a signal indicative of mechanical vibrations of the substrate die by the resonant frequency selectively facilitating responsiveness to mechanical vibrations and unresponsiveness to acoustical vibrations, and wherein the step of forming comprises forming a MEMs capacitive microphone comprising a backplate separated from a sensor membrane by an air gap, and forming a MEMs capacitive accelerometer comprising a suspended mass suspended by at least one beam, and characterised in that the step of forming further comprises forming the suspended mass to have a smaller area than the sensor membrane , and in that the geometries of at least one of the suspended mass and the at least one beam are adapted such that the resonant frequency of the accelerometer is within a predetermined frequency range.

8. The method of claim 7, wherein the substrate die comprises a plurality of layers, and wherein the microphone and the accelerometer are formed so as to share at least one layer of the substrate die.

9. The method of claim 8 wherein the step of forming the capacitive microphone and the accelerometer comprises:

patterning an upper layer of the multilayered substrate die to define first and second portions of the upper layer;

depositing a sacrificial layer and a backplate layer over the upper substrate layer;

etching the backplate layer to define openings above the first and second portions of the upper substrate layer;

removing a portion of the sacrificial layer above the first and second portions of the upper substrate layer by etching through the backplate openings, thereby forming the suspended mass from the backplate layer above the second portion of the upper substrate layer; and removing a portion of a lower layer of the multilayered substrate die beneath the first portion of the upper substrate layer, thereby forming the sensor membrane from the first portion of the upper substrate layer and forming the backplate from the backplate layer above the first portion of the upper substrate layer.

10. The method of claim 8, wherein the substrate die comprises a multi-layered silicon wafer having at least one layer of polysilicon.

11. The microphone of claim 1, wherein the suspended mass and the at least one beam are configured and arranged such that the resonant frequency of the accelerometer is within the range of 20 kHz-100 kHz.

12. The microphone of claim 11, wherein the suspended mass is configured and arranged to mitigate sensitivity to acoustical pressure by the resonant frequency being outside an acoustical bandwidth of the microphone.

13. The microphone of claim 1, wherein the suspended mass includes at least first and second ends and each of the at least one beam is attached to a respective one of the first and second ends of the suspended mass.

14. The microphone of claim 1, wherein the at least one beam is configured and arranged to provide accelerometer sensitivity in a direction that is perpendicular to the substrate plane, the at least one beam being configured and arranged to facilitate compliance in the direction perpendicular to the substrate plane as opposed to compliance in the direction parallel to the substrate plane.

15. A microphone device comprising:

a substrate die; and a capacitive microphone and an accelerometer formed from the substrate die, wherein the accelerometer is configured and arranged with a resonant frequency to provide a signal indicative of mechanical vibrations of the substrate die by the resonant frequency selectively facilitating responsiveness to mechanical vibrations and unresponsiveness to acoustical vibrations, wherein the microphone is a MEMs capacitive microphone comprising a backplate separated from a sensor membrane by an air gap, and wherein the accelerometer is a MEMs capacitive accelerometer comprising a suspended mass suspended by at least one beam.

* * * * *